US006558019B2

(12) United States Patent
Iida et al.

(10) Patent No.: US 6,558,019 B2
(45) **Date of Patent: *May 6, 2003**

(54) BULB-SHAPED FLUORESCENT LAMP

(75) Inventors: Shiro Iida, Takatsuki (JP); Takeshi Matsumura, Kashiwara (JP); Kenji Itaya, Takatsuki (JP); Nobuharu Hata, Kameoka (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/075,307

(22) Filed: Feb. 15, 2002

(65) Prior Publication Data

US 2002/0109988 A1 Aug. 15, 2002

Related U.S. Application Data

(63) Continuation of application No. 09/588,300, filed on Jun. 7, 2000.

(30) Foreign Application Priority Data

Jun. 16, 1999 (JP) ..... 11-169264

(51) Int. Cl.[7] ..... F21V 29/00; H01J 7/24

(52) U.S. Cl. ..... 362/218; 362/216; 362/225; 362/373; 313/11

(58) Field of Search ..... 362/216, 218, 362/225, 294, 373; 313/11, 42–44, 46, 318.02, 318.08, 484, 485; 315/56–63

(56) References Cited

U.S. PATENT DOCUMENTS

| | | | | |
|---|---|---|---|---|
| 4,225,905 A | | 9/1980 | Moriyama et al. | 362/216 |
| 4,363,083 A | | 12/1982 | Tanaka et al. | 362/216 |
| 4,375,607 A | | 3/1983 | Morton et al. | 315/56 |
| 4,417,176 A | | 11/1983 | Kamei et al. | 315/59 |
| 4,520,436 A | | 5/1985 | McNair et al. | 362/216 |
| 4,603,277 A | | 7/1986 | Imamura et al. | 313/25 |
| 4,694,215 A | | 9/1987 | Hofmann | 313/44 |
| 4,748,380 A | * | 5/1988 | MacDonald et al. | 315/57 |
| 4,809,142 A | | 2/1989 | Auerbach | 362/216 |
| 4,937,487 A | | 6/1990 | Blaisdell et al. | 313/44 |
| 5,128,590 A | | 7/1992 | Holzer | 315/58 |
| 5,828,170 A | | 10/1998 | Nishio et al. | 313/493 |
| 5,834,889 A | | 11/1998 | Ge | 313/493 |
| 5,877,585 A | | 3/1999 | Fulop et al. | 313/318.02 |
| 6,051,930 A | * | 4/2000 | Hammer et al. | 315/58 |
| 6,144,146 A | * | 11/2000 | Cserteg et al. | 313/318.02 |
| 6,297,585 B1 | * | 10/2001 | Tashiro et al. | 313/318.08 |

FOREIGN PATENT DOCUMENTS

| | | |
|---|---|---|
| DE | 3417601 A1 | 11/1985 |
| EP | 0 210 877 A1 | 2/1987 |
| JP | 61-96647 | 5/1986 |
| JP | 10-40866 | 2/1998 |
| JP | 2000-21355 | 1/2000 |

* cited by examiner

*Primary Examiner*—Alan Cariaso
(74) *Attorney, Agent, or Firm*—Parkhurst & Wendel, L.L.P.

(57) ABSTRACT

A less costly bulb-shaped fluorescent lamp with improved assembly efficiency is provided which prevents the impairment of product quality due to the change in color of a holder or the slipping off of a fluorescent tube from the holder decreased in resin strength. The fluorescent lamp includes a set of fluorescent tubes, filament coils disposed at both ends of each fluorescent tube, a starter circuit for activating the fluorescent tubes, a holder for retaining the fluorescent tubes, and a case containing the starter circuit. The holder includes holes for receiving the fluorescent tubes, and a recess defined in a central portion of the holder and extended in the opposite direction of the fluorescent tubes.

5 Claims, 4 Drawing Sheets

BULB-SHAPED FLUORESCENT LAMP

This is a Continuation of application Ser. No. 09/588,300 filed Jun. 7, 2000.

FIELD OF THE INVENTION

The present invention relates to a bulb-shaped fluorescent lamp.

BACKGROUND OF THE INVENTION

As shown in FIG. 6, a holder for use in a conventional fluorescent bulb is arranged such that a front face is flat at its central portion and formed with three holes 10*a* for receiving fluorescent tubes 1 (not shown) including, for example, three U-shaped tubes 1*a* interconnected in a manner to encompass the central portion.

The fluorescent tubes 1, shown in FIG. 7, are inserted in the hole 10*a* and then retained by the holder 10 with a silicone adhesive 8 injected from a rear side of the holder 10, as standing upright in encompassing relation to the central portion of the holder 10. Thus, a large amount of silicone adhesive 8 is used for filling a gap in the rear portion of the holder so that the fluorescent tubes 1 may be positively retained by the holder 10.

The holder 10 is formed of a polyethylene terephthalate resin containing glass filler. The continuous service temperature for this resin is defined to range from 150° C. to 155° C. inclusive (Japan: Electric Appliances Regulations, US: UL Standard).

However, the conventional fluorescent bulbs encounter a problem that heat builds up in a space encompassed by the fluorescent tubes 1 so that a portion of the holder 10 encompassed by the fluorescent tubes 1 or the central portion of the holder 10 is subject to serious temperature rise beyond the specified temperature (150° C.-155° C.). Consequently, the resin is decomposed to change the holder 10 in color and the product quality impaired.

The resin decomposition also decreases the resin strength so that the fluorescent tube 1 may slip off the holder 10. It is noted, however, that the fluorescent tubes 1 are normally connected to a starter circuit via a lead-in wire and therefore, even when slipped off the holder 10, the fluorescent tubes 1 are allowed to hang on the lead-in wire keeping the fluorescent tubes from free fall.

A large amount of silicone adhesive 8 is used for fixing the fluorescent tubes 1 to the holder 10. This leads not only to cost increase but also to significant decrease in assembly efficiency due to extended curing time.

In a case where such a lamp has a globe (not shown), heat from the lamp operation causes a large amount of low molecular siloxane to be released from the silicone adhesive 8 used in large quantity. The low molecular siloxane, in turn, will cloud the globe (not shown), resulting in extreme reduction of luminous flux or impaired product quality.

In view of the foregoing, it is an object of the invention to provide a less costly bulb-shaped fluorescent lamp with improved assembly efficiency which prevents the product quality impairment due to change in color of the holder or the slipping off of the fluorescent tube from the holder reduced in resin strength.

It is another object of the invention to provide a bulb-shaped fluorescent lamp adapted to reduce the clouding of the globe thereby preventing the extreme reduction of luminous flux or the impairment of product quality.

SUMMARY OF THE INVENTION

In accordance with the invention, a bulb-shaped fluorescent lamp comprises a set of fluorescent tubes, each tube being provided with filament coils at both ends thereof, a starter circuit for activating the fluorescent tubes, a holder for retaining the fluorescent tubes, and a case containing the starter circuit, wherein predetermined means is provided for lowering temperature at a portion of the holder encompassed by the fluorescent tubes.

Thus, the invention is designed to prevent the product quality from being impaired by the holder changed in color and the fluorescent tubes from slipping off the holder reduced in resin strength, as well as to accomplish improved assembly efficiency and cost reduction.

DESCRIPTION OF THE PREFERRED EMBODIMENTS

A preferred embodiment of the invention will hereinbelow be described with reference to the accompanying drawings.

Figure 1:
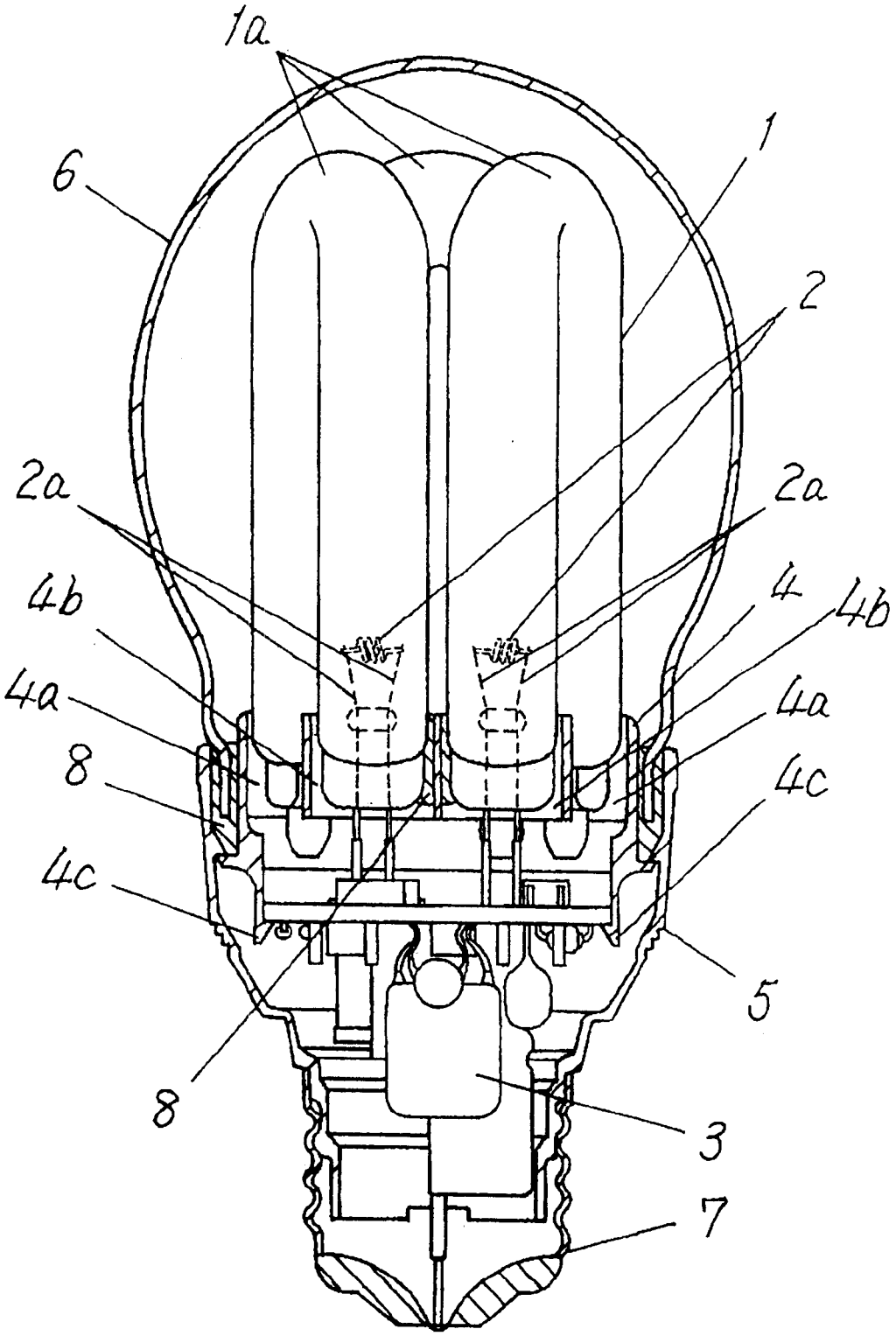
FIG. 1 is a front elevation partly broken away to show a bulb-shaped fluorescent lamp according to an embodiment of the invention.

According to an embodiment of the invention, a bulb-shaped fluorescent lamp rated at 13 W has a total length of 123 mm and a maximum outside diameter of 60 mm. As shown in FIG. 1, the fluorescent lamp includes a set of fluorescent tubes 1 each having an outside diameter of 11 mm. The set of fluorescent tubes comprise three U-shaped tubes 1*a* bridge-connected with each other, filament coils 2 disposed at both ends of each fluorescent tube 1, a starter circuit 3 for activating the fluorescent tubes 1, a holder 4 for retaining the fluorescent tubes 1 and starter circuit 3, a case containing the starter circuit 3, and a globe 6 containing the fluorescent tubes 1.

An annular ring is indicated at 7 in FIG. 1.

Figure 2:
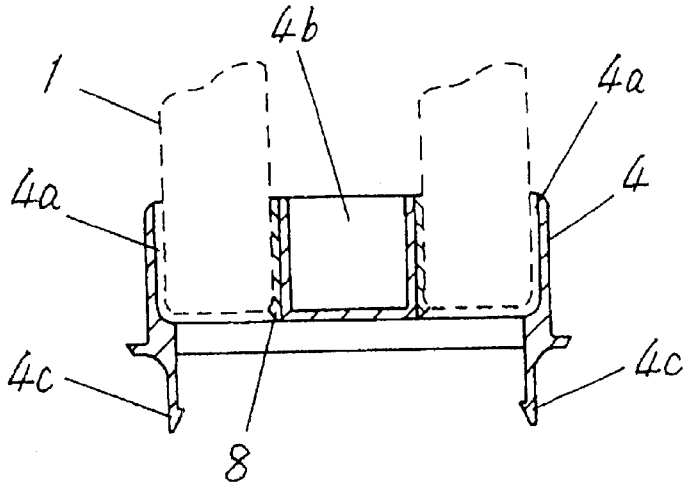
FIG. 2 is a sectional side elevation showing a holder used in the bulb-shaped fluorescent lamp.

The fluorescent tubes 1, as shown in FIG. 2, are securely held by the holder 4 by means of a silicone adhesive 8 filled in a gap between the fluorescent tubes 1 and a recess 4*b* to be described later, in an encompassing fashion around a predetermined space.

A fluorescent coating (not shown) is applied to an inside surface of the fluorescent tube 1. The fluorescent tube 1 is filled with a predetermined amount of mercury gas and low-pressure gas, respectively.

As shown in FIG. 1, the filament coil 2 is supported between lead-in wires 2*a* connected to the starter circuit 3.

The holder 4, case 5 and globe 6 are securely bonded to one another by means of the silicone adhesive 8.

Figure 3:
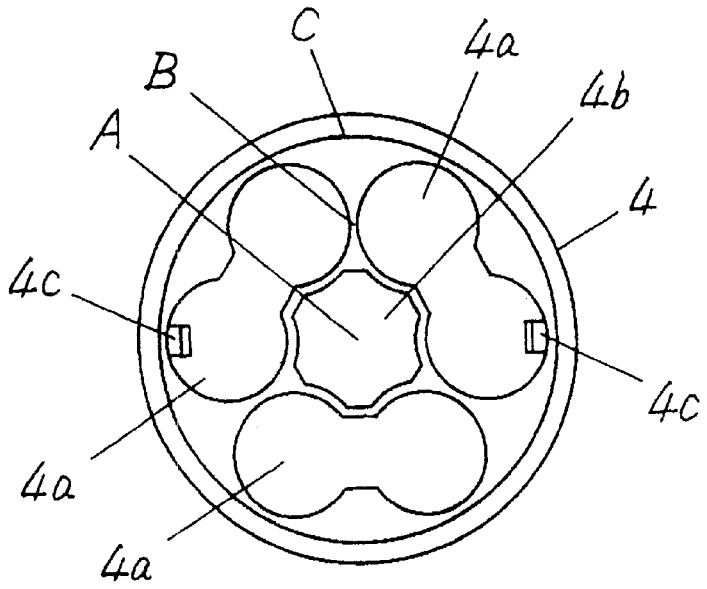
FIG. 3 is a front elevation showing the holder used in the bulb-shaped fluorescent lamp.

The holder is formed of polyethylene terephthalate containing glass filler and has an outside diameter of 43 mm. The holder 4, as shown in FIGS. 2 and 3, includes three holes 4*a* for receiving the fluorescent tubes 1 (not shown in FIG. 3), the recess 4*b* defined in a central portion of the holder 4 to be 10 mm deep in the opposite direction to the fluorescent tubes 1 and adapted as means for lowering temperature at a portion of the holder 4 being encompassed by the fluorescent tubes 1, and a lock portion 4*c* to which the starter circuit 3 is locked. The recess 4*b* is substantially formed like a prism and configured in conformity with an outline of the space encompassed by the fluorescent tubes 1.

The fluorescent tubes 1 thus held by the holder 4 stand upright in a manner to encompass the central portion of the holder 4.

Now, description will be made on working effects of the bulb-shaped fluorescent lamp of this arrangement (hereinafter, referred to as "inventive lamp").

Particularly, to determine the effect of the portion of the holder being encompassed by the fluorescent tubes or of the provision of the recess in the central portion of the holder, there were fabricated the inventive lamp and a bulb-shaped fluorescent lamp (hereinafter, referred to as "conventional lamp") of a similar arrangement to that of the inventive lamp except that the central portion of the holder is a flat plane without the recess. Each of the lamps were detected for temperature and retention of luminous flux after 2000-hours operation at three portions of the holder during steady lamp operation. The three portions includes the central portion of the holder (an area "A" in FIG. 3), a holder portion closest to the filament coil (an area "B" in FIG. 3) and a side portion of the holder (an area "C" in FIG. 3). The results are shown in Table 1.

In the measurement, a bare bulb was used without any lighting equipment, under an input voltage of 100 V and an ambient temperature of 30° C.

Table 1 also indicates the change in color of the holder, the slipping off of the fluorescent tube from the holder and the use of the silicone adhesive.

TABLE 1

| | Inventive Lamp | Conventional Lamp |
|---|---|---|
| Holder Temperature (° C.) | | |
| Central portion | 143 | 178 |
| Closest Portion to Filament Coil | 132 | 148 |
| Side Portion | 102 | 113 |
| Change in Color | None | Changed |
| Occurrence of Slipping off | None | Occurred |
| Amount of Silicon Adhesives Used (g) | 3 | 8 |
| Retention of Luminous Flux (%) | 86 | 78 |

As apparent from Table 1, both the inventive lamp and the conventional lamp presented the highest temperatures at the center of the holder. The temperature at the holder center of the inventive lamp reached the highest point of 143° C., whereas the temperature at the holder center of the conventional lamp rose as high as 178° C. Thus, the inventive lamp has accomplished 20% reduction in the temperature rise at the central portion of the holder as compared to the conventional lamp. This demonstrates that the inventive lamp can control the temperature within the range specified by the Electric Appliance Regulations.

Besides the holder center of the inventive lamp, the closest portion to the filament coil and the side portion of the holder also accomplished 16% and 11% reduction in the temperature rise as compared to the conventional lamp, respectively, the former standing at 132° C. and the latter at 102° C.

None of the inventive lamps suffered the change in color of the holder throughout the rated service life. In contrast, the conventional lamp started to turn yellow at the central portion of the holder after 15-hours operation.

None of the inventive lamps suffered the slipping off of the fluorescent tube 1 from the holder 4. On the other hand, the fluorescent tube slipped off the holder of the conventional lamp.

The inventive lamp required minimum 3 g of the adhesive for fixing the fluorescent tubes to the holder, whereas the conventional lamp required minimum 8 g of the adhesive. It was thus determined that the inventive lamp can reduce the use of the silicone adhesive by 63% as compared to the conventional lamp.

The temperature rise of the holder 4 is decreased by virtue of the recess 4*b* defined in the portion of the holder 4 encompassed by the fluorescent tubes 1, and extended in the opposite direction to the fluorescent tubes 1. This is effective to suppress the resin decomposition causing the change in color of the holder 4 and to prevent the decrease in resin strength of the holder 4 which entails the slipping off of the fluorescent tube 1 therefrom. The impairment of product quality, in particular, is prevented by suppressing the change in color of the holder 4. In addition, the holder 4 is capable of positively holding the fluorescent tubes 1 with the reduced amount of the silicone adhesive and hence, the costs and curing time are reduced. The reduced curing time contributes to improved assembly efficiency.

As apparent from Table 1, the inventive lamp presents the retention of luminous flux of 86%. In contrast, the conventional lamp has the retention of luminous flux of 78%, also suffering the clouding of the globe. This indicates that the inventive lamp suppresses the clouding of the globe 6 and accomplishes 10% greater retention of luminous flux than the conventional lamp.

The inventive lamp with the globe 6 features the recess 4*b* defined in the portion of the holder encompassed by the fluorescent tubes 1 and extended in the opposite direction to the fluorescent tubes 1, the recess contributing to the reduced use of the silicon adhesive 8, thereby reducing the low molecular siloxane released from the silicone adhesive 8. Thus, the inventive lamp prevents the globe 6 from being clouded so that the extreme reduction of luminous flux or the impairment of product quality may be avoided.

As mentioned supra, the recess 4*b* is preferably configured to conform to the outline of the space encompassed by the fluorescent tubes 1.

This allows a portion of the holder 4 which is between the recess 4*b* and the fluorescent tubes 1 to be reduced in thickness so that the portion of the holder 4 encompassed by the fluorescent tubes 1 may be at even lower temperatures. In consequence, the whole body of the holder 4 including the side surface may be further reduced in temperature.

Figure 4:
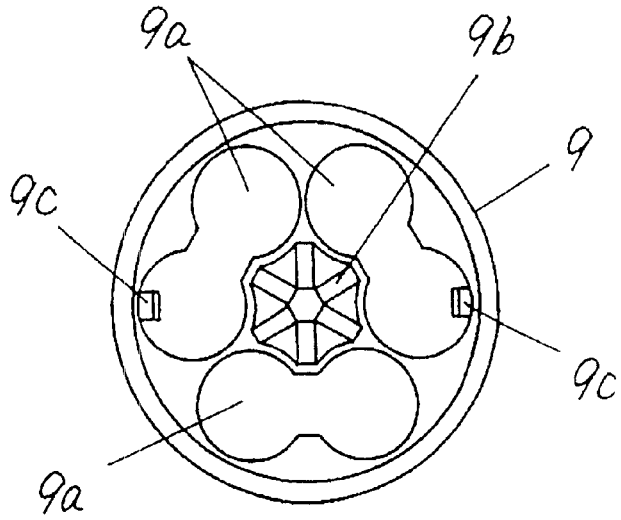
FIG. 4 is a front elevation showing another holder used in the bulb-shaped fluorescent lamp.
Figure 5:
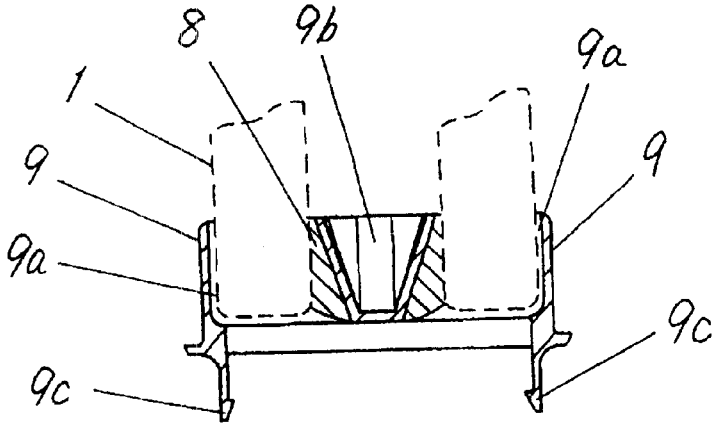
FIG. 5 is a sectional side elevation showing the another holder used in the bulb-shaped fluorescent lamp.
Figure 6:
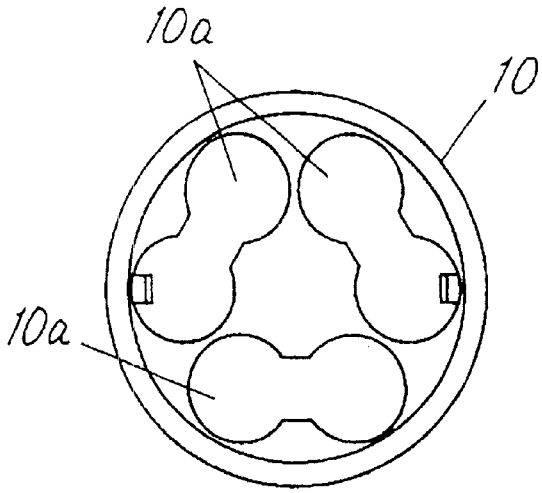
FIG. 6 is a front elevation showing a holder used in a conventional bulb-shaped fluorescent lamp.
Figure 7:
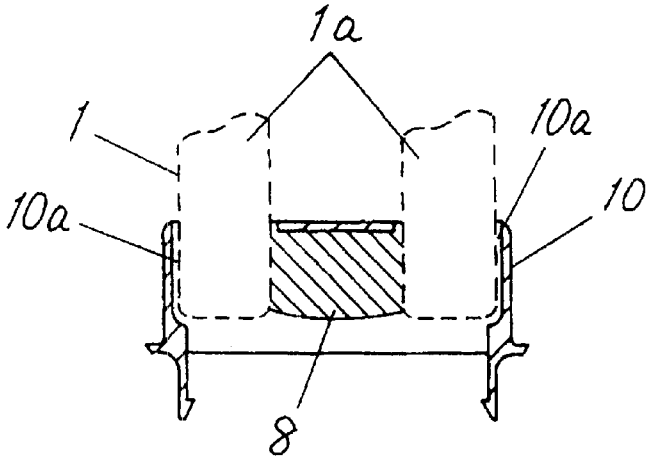
FIG. 7 is a sectional side elevation showing the holder used in the conventional bulb-shaped fluorescent lamp.

The holder 4 may be replaced by a holder 9 shown in FIGS. 4 and 5.

The holder 9 is 43 mm in outside diameter and formed of the same polyethylene terephthalate with glass filler as the holder 4. The holder 9 includes three holes 9*a* for receiving the fluorescent tubes 1 (not shown in FIG. 4), a 10 mm-deep recess 9*b* defined in the central portion of the holder 9 to extend in the opposite direction to the fluorescent tubes 1 and adapted as means for lowering the temperature of the portion of the holder 9 encompassed by the fluorescent tubes 1, and a lock portion 9*c* to which the starter circuit 3 is locked. Unlike that of the holder 4, the recess 9*b* is tapered with its diameter progressively decreased toward its front end.

Since the holder 9 includes the tapered recess 9*b*, the filling of the silicon adhesive 8 can be adjusted to an optimum amount by changing the inclination of the tapered surface of the recess 9*b*. In addition, the tapered recess provides a broader area on the rear side of the holder 9 from which the silicone adhesive 8 is injected, facilitating the filling of the silicone adhesive 8. Hence, the assembly efficiency is further improved.

The recess 4*b*, 9*b* preferably has a depth of not less than 3 mm such that the holder 4, 9 may be further reduced in temperature. However, the recess 4*b*, 9*b* may not be so deep as to come in contact with the starter circuit 3.

Although the foregoing embodiment has been described by way of example of the fluorescent tubes 1 comprising three U-shaped tubes bridge-connected with each other, the invention should not be limited to the above. The similar effects may be attained by any arrangement wherein at least the holder retains the both ends of the fluorescent tubes. The invention is particularly suitable for illumination devices with three or more U-shaped tubes bridge-connected with each other or with six or more linear tubes bridge-connected with each other.

In the foregoing embodiment, the predetermined means for lowering the temperature of the portion of the holder 4 encompassed by the fluorescent tubes 1 takes the form of the recess 4*b* defined in the portion of the holder 4 encompassed by the fluorescent tubes and extended in the opposite direction to the fluorescent tubes 1. The similar effect to the above may be attained by an arrangement wherein, for example, the holder portion encompassed by the fluorescent tubes 1 is connected with the exterior of the lamp by means of a heat conductive material such as the silicone adhesive.

As mentioned supra, the invention provides the less costly bulb-shaped fluorescent lamp with improved assembly efficiency, thereby preventing the impairment of product quality due to the holder changed in color and the slipping off of the fluorescent tube from the holder reduced in resin strength.

Also, the invention provides the bulb-shaped fluorescent lamp with the globe which is adapted to suppress the clouding of the globe, thereby preventing the extreme reduction of luminous flux or the impairment of product quality.

What is claimed is:

1. A bulb-shaped fluorescent lamp having a globe end and an electrical contact end comprising a plurality of fluorescent tubes, each tube having a filament coil at each end thereof, a starter circuit electrically connected for activating gas in the fluorescent tubes, a holder and adhesive retaining the fluorescent tubes, and a case containing the starter circuit and the holder, the holder having a recess for lowering a temperature of a portion of the holder and adhesive, the portion being surrounded by each end of the fluorescent tubes, the recess being extended to project in a direction opposite the fluorescent tubes and not communicating with a space between the holder and the electrical contact end of the lamp.

2. The bulb-shaped fluorescent lamp according to claim 1, wherein the plurality of fluorescent tubes comprises at least three U-shaped tubes or at least six linear tubes bridge-connected with each other.

3. A bulb-shaped fluorescent lamp according to claim 1, further comprising a globe for covering the fluorescent tubes.

4. A bulb-shaped fluorescent lamp according to claim 1, wherein the recess conforms to an outline of a space encompassed by the fluorescent tubes.

5. A bulb-shaped fluorescent lamp according to claim 1, wherein the recess has a depth of not less than 3 mm.

* * * * *